US005783763A

United States Patent [19]

Schaller et al.

[11] Patent Number: 5,783,763

[45] Date of Patent: Jul. 21, 1998

[54] BI-DIRECTIONAL VIBRATO MECHANISM FOR A GUITAR

[75] Inventors: Helmut F. K. Schaller, Feucht; Rene Schaller, Pyrbaum, both of Germany

[73] Assignee: Schaller Electronic, Feucht, Germany

[21] Appl. No.: 806,941

[22] Filed: Feb. 26, 1997

[51] Int. Cl.[6] ..... G10D 3/04

[52] U.S. Cl. ..... 84/313; 84/298

[58] Field of Search ..... 84/313, 298, 307

[56] References Cited

U.S. PATENT DOCUMENTS 3,252,368 5/1966 Jeffery et al. ..... 84/313

5,520,082 5/1996 Armstrong et al. ..... 84/313

*Primary Examiner*—Michael L. Gellner

*Assistant Examiner*—Shih-yung Hsieh

*Attorney, Agent, or Firm*—McCormick, Paulding & Huber

[57] ABSTRACT

A bi-directional vibrato mechanism for use with a stringed musical instrument is capable of being mounted to an instrument body without the need for providing additional holes or recesses in the instrument body for receiving portions of the mechanism. A front part of the mechanism is attachable to the guitar by two mounting posts and includes bridge type support members for the strings. A rear part is pivotally supported on the front part and anchors the lower ends of the strings. Two sets of springs located entirely above the top surface of the instrument body resiliently resist pivotal movement of the rear part relative to the front part in both pivotal directions away from a normal tuned position.

13 Claims, 2 Drawing Sheets

BI-DIRECTIONAL VIBRATO MECHANISM FOR A GUITAR

FIELD OF THE INVENTION

The invention relates to guitars and similar stringed musical instruments, and deals more particularly with a vibrato mechanism for use with such an instrument to allow a player, with his strumming hand, to vary the tension of the instrument's strings during playing to produce a vibrato effect in the sound produced by the instrument during playing.

BACKGROUND OF THE INVENTION

As shown, for example, by U.S. Pat. Nos. 4,984,493 and 5,196,641, devices, referred to a vibrato mechanisms or tremolo mechanisms, are well known in the musical instrument art. Such mechanisms provide a bridge for the strings of the instrument and a tail piece for anchoring the lower ends of the strings, and they also include a means, actuated by a hand operable lever so that during the playing of the instrument, the player, with his strumming hand, can vary the tensions of all of the strings simultaneously and in an oscillatory manner to correspondingly change the pitches of the sounds produced by the strings in an oscillatory way to create a vibrato effect in the ultimate sound produced by the instrument. Some vibrato mechanisms are capable of varying the string tensions in only one direction; that is, in either the string loosening or the string tightening direction away from the normal tensions. However, to produce a true vibrato effect, it is preferred that such a mechanism be capable of varying the string tension in both directions away from the normal tension; that is, in both the string loosening direction and the string tightening direction.

Previous constructions of vibrato mechanisms, especially bi-directional ones capable of varying the string tensions in both string loosening and string tightening directions, have been of relatively large and complex design and have usually required the forming in the instrument body of relatively large holes or recesses for accommodating various portions of the mechanism, thereby making the mechanisms best suited for use only with solid body instruments.

The general object of the present invention is, therefore, to provide a bi-directional vibrato mechanism which is of a simple and compact design allowing it to be applied to a guitar or similar stringed instrument without the need for forming recesses or other openings in the top surface of the instrument body.

A more specific object of the invention is to provide a vibrato mechanism of the aforesaid kind which is particularly well adapted for use with semi-acoustic guitars, that is, guitars with hollow bodies and with a relatively heavy wooden support member located inside of the body immediately beneath the top plate of the body and extending along the full length of the body as a continuation of the neck structure, and which vibrato mechanism can be mounted to the guitar using nothing more than the two mounting posts conventionally provided on semi-acoustic guitars for the mounting of conventional bridge and tailpiece assemblies.

Further objects and advantages of the invention will be apparent from the following detailed description of a preferred embodiment and from the accompanying drawings and claims.

SUMMARY OF THE INVENTION

The invention resides in a bi-directional vibrato mechanism for use with a guitar or similar stringed instrument for mounting on the top surface of the instrument body and for receiving and anchoring the lower ends of the strings which extend over a portion of the instrument body above its top surface, the mechanism having bridge type supporting elements for the strings, and the mechanism being comprised of a front part for fixed attachment to the instrument body and carrying the string support elements and a rear part pivotally connected with the front part for rotation relative to the front part about an axis extending transversely of the strings and having anchoring slots or other means for anchoring the lower ends of the strings, there being a first spring means working between the first and second parts for resiliently resisting movement of the rear part relative to the front part in the string loosening direction away from a normal position of the rear part and a second spring means working between the front and rear parts for resiliently resisting movement of the rear part relative to the front part in the string tightening direction of the rear part away from the normal position, the front part having a lowermost bottom surface which is located in engagement with or slightly above the top surface of the instrument when the mechanism is attached to the instrument and all of the components making up the first spring means and the second spring means being located at a level above such lowermost bottom surface of the front part so that no holes or other recesses need be provided in the top surface of the instrument to accommodate such components.

The invention also resides in at least one of the spring means being implemented by at least one leaf spring working between the front and rear parts.

The invention also resides in the front and rear parts being formed in significant part by front and rear bodies made of die cast or other relatively soft metal and in said bodies carrying members of harder metal at strategic areas to allow the mechanism to be made at reasonable cost while retaining qualities of sturdiness, long life and smooth precision operability.

The invention also resides in other detailed features of the mechanism as set forth in the appended claims.

DESCRIPTION OF THE PREFERRED EMBODIMENT

Figure 1:
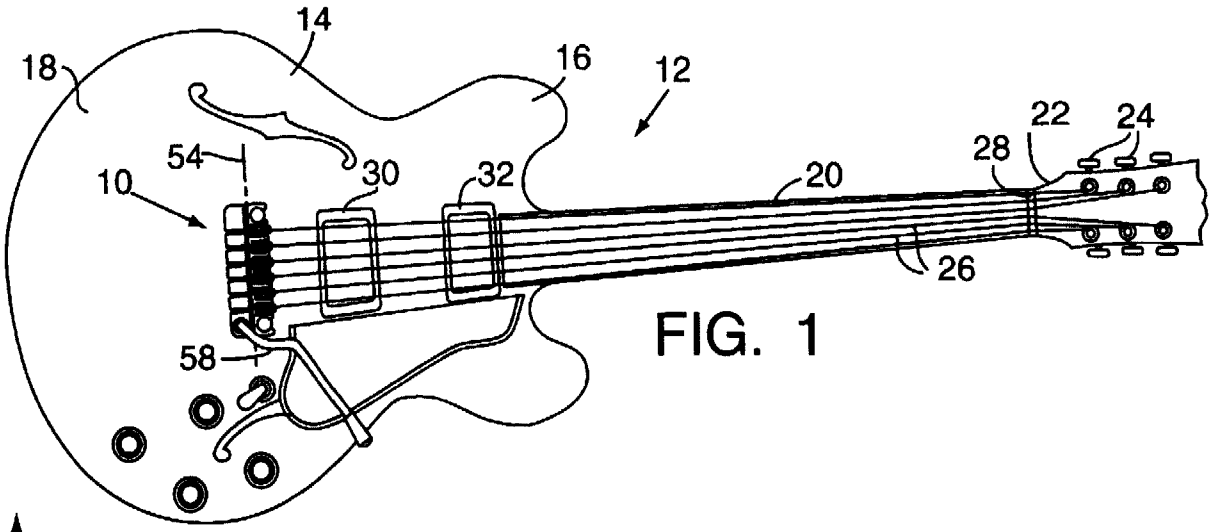
FIG. 1 is a plan view of a guitar equipped with a bi-directional vibrato mechanism embodying the invention.
Figure 3:
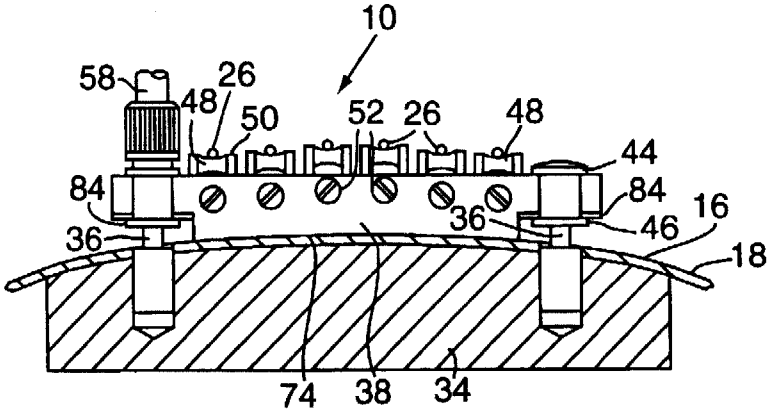
FIG. 3 is a view taken on the line 3—3 of FIG. 2 showing the front end of the vibrato mechanism in elevation and the body of the guitar in section.

In FIG. 1 a vibrato mechanism 10 embodying the invention is shown installed on a guitar 12. The mechanism 10 may be used with various different types of guitars or similar stringed musical instruments, but preferably, and as shown in the drawings, the guitar 12 is a semi-acoustic one having a hollow body 14 including an arched top plate 16, as seen in FIG. 3, defining the top surface 18 of the guitar. A neck 20 extends upwardly from the body 12 and at its outer end carries a peghead 22 having six machine heads 24 for receiving and holding the upper ends of the strings 26, with each string extending from its associated machine head 24 over a nut 28 to the vibrato mechanism 10 where it passes over a bridge type support element on the mechanism 10 and, beyond the support element, is anchored to the vibrato mechanism. The strings 26, therefore, pass over the top surface 18 of the guitar for a portion of the length of the guitar body, and they also pass over two magnetic pickups 30 and 32 carried by the guitar body to allow electrical amplification, if desired, of the sound produced by the guitar.

As seen best in FIG. 3, the guitar body, in its interior, includes a strengthening member 34, preferably made of wood and forming a continuation of the neck 20, which runs essentially along the length of the body 12 and engageably supports the middle portion of the top plate 16. As is customary for many semi-acoustic guitars, the strengthening member 34 supports two mounting posts 36 of the type often used to attach simple bridge and tailpiece assemblies to the guitar, and the vibrato mechanism 10 is, in the illustrated case, designed to be cooperable with such posts 36 for its mounting to the guitar. However, in its broader aspects, the vibrato mechanism of the invention is not limited to such type of mounting and it may, if desired, be adapted for use with various other means for fastening it to the guitar body.

Figure 2:
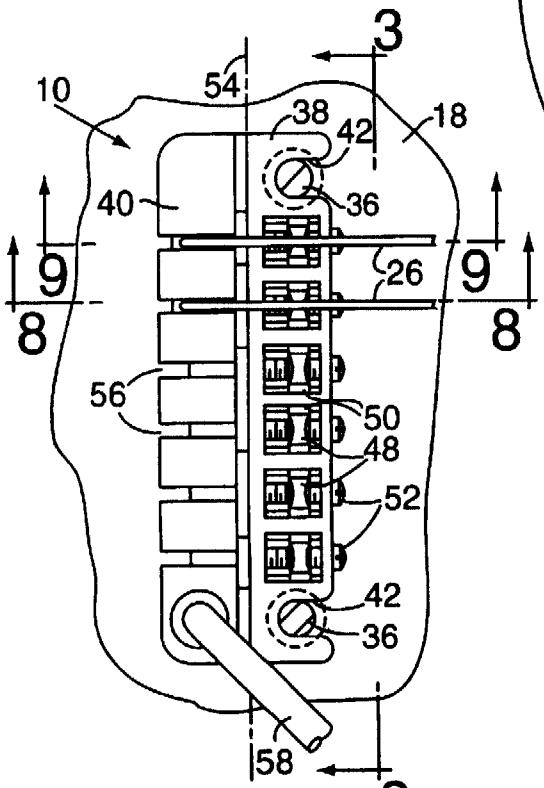
FIG. 2 is a fragmentary view of FIG. 1 showing the vibrato mechanism in larger scale, with four of the strings removed and with the mounting posts being shown in section.

As seen in FIGS. 2 and 3, the vibrato mechanism 10 is comprised basically of a front part 38 and a rear part 40, both of which parts are of generally rectangular shape as seen in FIG. 2 and extend in a direction transversely of the strings 26. At its opposite end portions, the front part 38 has two slots 42 for slidably receiving the mounting posts 36. Each mounting post has upper and lower flanges 44 and 46 which snugly engage the part 38 to inhibit rocking motion between the part 38 and the mounting post, yet the part 38 is slidable relative to the post to allow its assembly with the posts by moving it in the direction toward the neck 20 to bring the posts 36 into the slots 42. After the part 38 is fully engaged with the mounting posts 36 and the strings 36 brought up to tuned tensions, the string tensions hold the part 38 to the posts 36.

The front part 38 carries six bridge-type support elements, one for each string 26, with each support element being in the form of a waisted roller 48. Each roller is supported by a saddle member 50 for rotation about an axis extending transversely to the strings 26, and each saddle is adjustable by an adjustment screw 52 in a direction parallel to the strings to allow adjustment of the string intonation.

The rear part 40 is supported on the front part 28 for rotation relative to the front part 38 about a pivot axis 54 extending transversely of the strings. Six slots 56 are provided in the rear part 40 for receiving in anchoring fashion the ball ended lower ends of the strings 26. A vibrato arm 58 is carried by the rear part 40 and is actuatable by the strumming hand of the player of the guitar 12 to move the rear part 40 in one direction or the other about the pivot axis 54.

Figure 5:
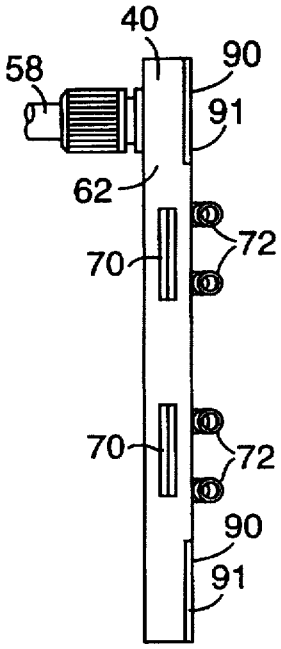
FIG. 5 is a view taken on the line 5—5 of FIG. 4 and showing the front end of the rear part of the mechanism in elevation.
Figure 8:
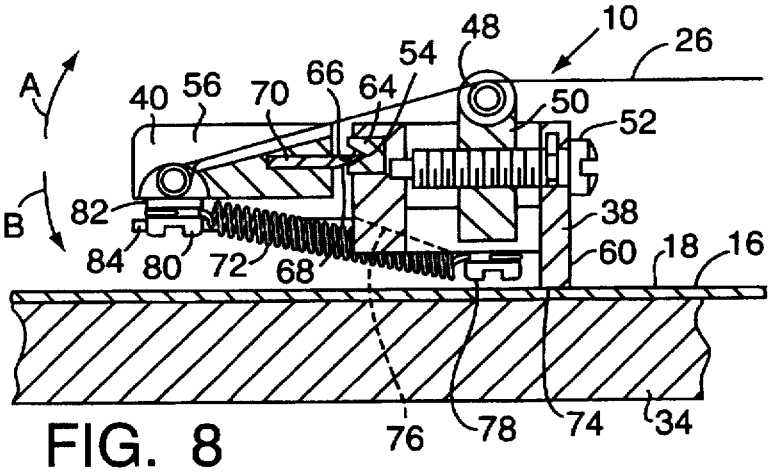
FIG. 8 is a longitudinal, vertical, sectional view taken through the vibrato mechanism on the line 8—8 of FIG. 2.

The front and rear parts 38 and 40 may be made in various ways from various different materials without departing from the broader aspects of the invention. Preferably, however, each of the two parts 38 and 40 is made primarily of a body of a relatively soft metal, such as a die cast metal, and parts of harder metal are applied to the body at strategic locations where needed to provide strength, to reduce wear and to provide smooth operation. In keeping with this and referring to FIGS. 5 and 6, the front part 38 is made up of a front body 60 of relatively soft metal and the rear part 40 is made up of a rear body 62 of relatively soft metal. The pivotal connection between the parts 38 and 40 is in turn provided by a bar 64 carried by the front body 60 and extending transversely of the strings. As best seen in FIG. 8, the bar 64 has a rearwardly facing groove 66 extending along its entire length and that groove 66 engagingly receives the forwardly positioned knife edge portions 68 of two bearing plates 70 carried by the rear body 62. Therefore, as illustrated in FIG. 8, the rear part 40 is movable relative to the front part 38, by pivoting of the bearing plates 70 in the groove 66 of the bar 64, in both the direction of the arrow A and the direction of the arrow B, rotation in the direction of the arrow A corresponding to a loosening of the tensions in the strings 26 and rotation in the direction B corresponding to a tightening or increase in the tensions of the strings.

The vibrato mechanism 10 further includes a first spring means for resiliently resisting movement of the rear part 40 in the string loosening direction relative to the front part 38 and a second spring means for resiliently resisting movement of the rear part 40 in the string tightening direction relative to the rear part 38. These two spring means may take various forms, but in the preferred and illustrated case, the first spring means for resisting movement of the rear part 40 in the string loosening direction comprises a set of four helical tension springs 72, each having two opposite ends connected respectively to the front part 38 and to the rear part 40, as best seen in FIG. 4.

Further, the front part 38, as best seen in FIGS. 3 and 8, in its front portion has a bottom surface 74 which defines the lowermost extent of the front part 38, is preferably shaped to conform to the arching of the top surface of the guitar body, and either lightly engages or is spaced a small distance above the top surface 18 of the guitar body. The bar 64 and bearing plates 70 providing the pivotal connection between the front and rear parts 38 and 40 are located a substantial distance above the bottom surface 74 of the front part 38 and the springs 72 are so arranged, and associated with the parts 38 and 40 as to be located entirely within the space between the bottom surface 74 and the pivot axis 54. To better accommodate the springs 72, the rear portion of the front part 38 has four grooves 76 which partially receive the springs 72. Each spring 72 has a loop on its forward end which is held to the part 38 by a screw 78 and a loop on its rear end which is held to the rear part 40 by a screw 80, with the loop being spaced from the bottom surface of the rear part 40 by a spacing washer 82 to prevent engagement of the main body of the spring with the rear part. Therefore, by provision of the grooves 76 and the spacing washers 82, the main bodies of the springs 72 are kept out of rubbing engagement with the parts 38 and 40 to allow for smooth pivoting movement of the rear part 40 relative to the front part 38.

Figure 4:
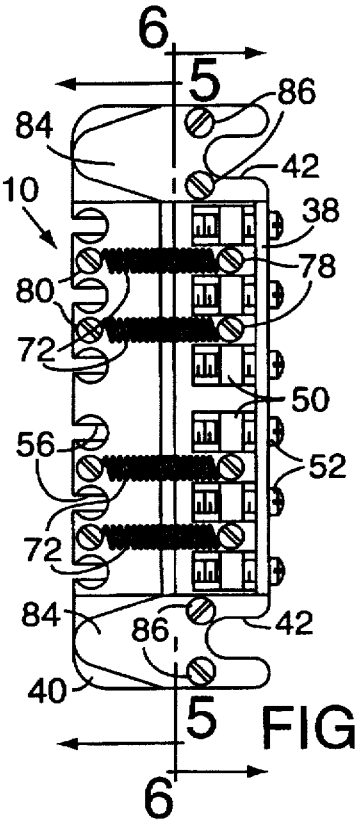
FIG. 4 is a view showing the bottom of the vibrato mechanism.
Figure 6:
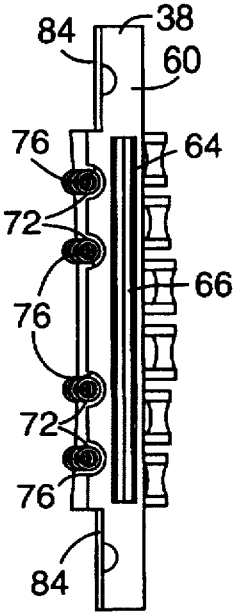
FIG. 6 is a view taken on the line 6—6 of FIG. 4 and showing the rear end of the front part of the vibrato mechanism in elevation.
Figure 7:
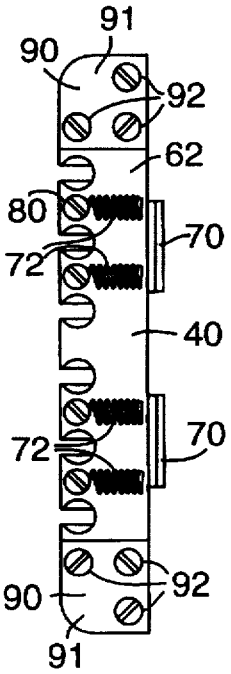
FIG. 7 is a view showing the bottom of the rear part of the vibrato mechanism with the front part of the vibrato mechanism being removed.
Figure 9:
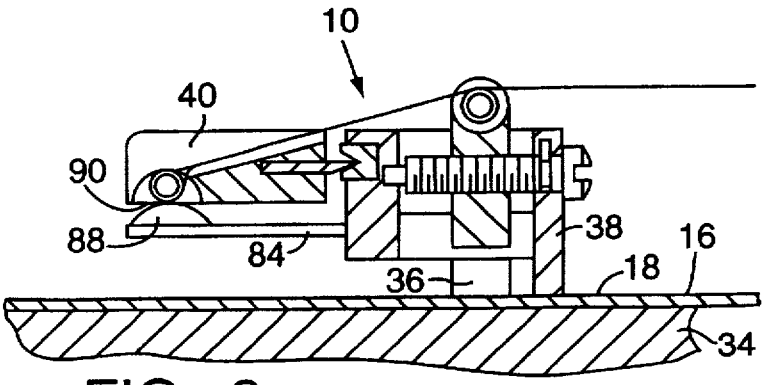
FIG. 9 is a longitudinal, vertical, sectional view taken through the vibrato mechanism on the line 9—9 of FIG. 2.

The second spring means for resiliently resisting string tightening movement of the rear part 40 relative to the front part 38 in the presently illustrated embodiment is also located between the bottom surface 74 of the rear part 38 and the pivot axis 54, and is provided by two leaf springs 84 of hard metal as seen best in FIGS. 4, 6 and 9 located at the lateral end portions of the parts 38 and 40. Each spring 84 has a forward portion fixedly attached to the front part 38 by two screws 86. A rear portion of each spring 84 extends rearwardly from the front part 38 and has a rounded protrusion 88 on its upper face which slidingly engages the bottom surface 90 of the rear part 40. In the two areas where this engagement occurs, the rear part 40 respectively carries two hard metal bearing plates 90, as shown in FIG. 7, each attached to the rear body 62 of the rear part 40 by three screws 92. Each spring 84 is located in the vicinity of one of the mounting slots 42 and thereby provides hard wear resistant surfaces for engagement with adjacent surfaces of the associated post 36.

Having now described the construction of the vibrato mechanism 10, its operation can be summarized by reference to FIGS. 1, 8 and 9. When the strings 26 of the guitar are tensioned to bring them up to desired normal tuning, the forces exerted on the rear part 40 by the strings, by the helical tension springs 72 and by the leaf springs 84 will cause the rear part 40 to assume a normal position relative to the front part 38, such as the position shown in FIGS. 8 and 9. If the player now wishes to introduce a vibrato effect onto the sound produced by the guitar, he can manipulate the lever 58 in an oscillatory manner to alternately move the rear part 40 in the string loosening and string tightening directions A and B away from the normal position to change the pitches of the sounds produced by the guitar by changing the string tensions. Whenever the player releases the vibrato lever 54, the rear part 40 will be returned to its tuned position by either the springs 72 or the springs 84 depending on whether the strings where loosened or tightened at the time of the lever's release.

We claim:

1. A bi-directional vibrato mechanism for use with a guitar having a body with a top surface and a set of strings extending over a portion of said body above said top surface, said vibrato mechanism comprising:

a front part for attachment to a guitar such as aforesaid, said front part carrying a plurality of supports for supporting the strings of said guitar and having a lowermost bottom surface which, when said front part is attached to a guitar, faces downwardly toward said top surface of the guitar, a rear part for anchoring attachment to the strings of the guitar, pivot means supporting said rear part on said front part for movement of said rear part relative to said front part in string tightening and string loosening directions about a pivot axis extending transversely to the strings of the guitar and generally parallel to said top surface of the guitar, at least one spring located above the level of said bottom surface of said front part and working between said front and rear parts to resiliently resist movement of said rear part relative to said front part about said pivot axis in said string tightening direction, and at least one other spring located above said level of said bottom surface of said front part and working between said front and rear parts to resiliently resist movement of said rear part relative to said front part about said pivot axis in said string loosening direction.

2. The vibrato mechanism as defined in claim 1, wherein:

one of said springs is a leaf spring.

3. The vibrato mechanism as defined in claim 1, wherein:

one of said springs is a helical tension spring.

4. The vibrato mechanism as defined in claim wherein:

said at least one spring is a leaf spring and said at least one other spring is a helical tension spring.

5. A bi-directional vibrato mechanism for use with a guitar having a body with a top surface and a set of strings extending over a portion of said body above said top surface, said vibrato mechanism comprising:

a front part for attachment to a guitar such as aforesaid, said front part carrying a plurality of supports for supporting the strings of said guitar and having a lowermost bottom surface which, when said front part is attached to a guitar, faces downwardly toward said top surface of the guitar, a rear part for anchoring attachment to the strings of the guitar, pivot means supporting said rear part on said front part for movement of said rear part relative to said front part in string tightening and string loosening directions about a pivot axis extending transversely to the strings of the guitar and generally parallel to said top surface of the guitar, said front part including a front body and at least one leaf spring located above the level of said bottom surface of said front part, said leaf spring having a front end portion fixed to said front body and a rear portion extending rearwardly from said front body and slidably engagable with said bottom surface of said rear part to resiliently resist movement of said rear part relative to said front part about said pivot axis in said string tightening direction, and at least one helical tension spring located above said level of said bottom surface of said front part and having two opposite ends connected respectively to said front and rear parts to resiliently resist movement of said rear part relative to said front part about said pivot axis in said string loosening direction.

6. The vibrato mechanism as defined in claim 5, wherein:

said supports are a plurality of rollers, one for each of said strings, each of which rollers is supported on said front body for rotation relative to said front body about an axis perpendicular to said strings.

7. The vibrato mechanism as defined in claim 5, wherein:

said rear part includes a rear body, and both said front body and said rear body are made of relatively soft metal.

8. The vibrato mechanism as defined in claim 7, wherein:

said rear part includes a plate of relatively hard metal for engagement with said rear portion of said leaf spring.

9. The vibrato mechanism as defined in claim 8, wherein:

said front body includes two opposite lateral end portions, said front part includes two leaf springs with front end portions fixed respectively to said opposite end portions of said front body, said rear body of said rear part has opposite lateral end portions, and two hard metal plates are fixed respectively to said opposite end portions of said rear body for slidable engagement respectively with rear portions of said two leaf springs.

10. The vibrato mechanism as defined in claim 9, wherein:

said front part includes two forwardly opening and rearwardly extending slots in its opposite lateral end portions for supporting engagement respectively with two posts fixed to said guitar body.

11. The vibrato mechanism as defined in claim 10, wherein:

said front portions of said two leaf springs are located in the vicinity of said slots and have downwardly facing bottom surfaces which are engagable with upwardly facing support surfaces on said two posts.

12. The vibrato mechanism as defined in claim 7, wherein:

said pivot means includes at least one first bearing part of relatively hard metal on one of said front and rear bodies and having a groove extending in a direction transversely of said strings, and at least one second bearing part of relatively hard metal carried by the other of said front and rear bodies and having a knife edge portion engaged in said groove of said first bearing part.

13. The vibrato mechanism as defined in claim 6, wherein:

said pivot means includes a bar of hard metal carried by one of said front and rear bodies and extending in a direction transversely of said strings along a substantial portion of said bodies and having a groove facing in a direction parallel to said strings, and two bearing plates of relatively hard metal carried by the other of said front and rear bodies and having knife edge portions engaged in said groove of said bar.

* * * * *